US008006322B1

(12) United States Patent
Schiebl

(10) Patent No.: US 8,006,322 B1
(45) Date of Patent: Aug. 30, 2011

(54) PADDED CHIN GUARD

(76) Inventor: Paul Schiebl, Houston, TX (US)

( * ) Notice: Subject to any disclaimer, the term of this patent is extended or adjusted under 35 U.S.C. 154(b) by 1097 days.

(21) Appl. No.: 11/752,100

(22) Filed: May 22, 2007

Related U.S. Application Data

(63) Continuation-in-part of application No. 11/222,283, filed on Sep. 8, 2005, now Pat. No. 7,735,160, which is a continuation-in-part of application No. 10/463,774, filed on Jun. 16, 2003, now abandoned.

(51) Int. Cl.
*A42B 7/00* (2006.01)

(52) U.S. Cl. ..... 2/421

(58) Field of Classification Search ..... 2/421, 411, 2/414, 425, 412, 417, 418, 422, 9, 410
See application file for complete search history.

(56) References Cited

U.S. PATENT DOCUMENTS

| | | | | |
|---|---|---|---|---|
| 2,867,811 | A * | 1/1959 | Jones | 2/421 |
| 3,619,813 | A * | 11/1971 | Marchello | 2/421 |
| 5,794,274 | A * | 8/1998 | Kraemer | 2/421 |
| 6,298,483 | B1 | 10/2001 | Schiebl et al. | |
| 6,481,024 | B1 * | 11/2002 | Grant | 2/421 |
| 6,499,147 | B2 | 12/2002 | Schiebl et al. | |

* cited by examiner

*Primary Examiner* — Tejash Patel
(74) *Attorney, Agent, or Firm* — Egbert Law Offices PLLC

(57) ABSTRACT

A chin guard has a shell with a cup suitable for fitting upon a human chin and a resilient layer received within in the cup of the shell. The resilient layer has a periphery overlying the outer peripheral edge of the shell. The resilient layer has a support layer in surface-to-surface contact with a surface of the shell. A plurality of padded sections are integrally formed with the support layer. The plurality of padded sections include a rectangular portion extending centrally across the support layer on a side opposite the cup and a plurality of fingers extending outwardly of the rectangular portion.

11 Claims, 3 Drawing Sheets

PADDED CHIN GUARD

CROSS-REFERENCE TO RELATED U.S. APPLICATIONS

The present application is a continuation-in-part of U.S. application Ser. No. 11/222,283, filed on Sep. 8, 2005 and entitled "Chin Guard Apparatus for use with a Helmet", presently pending. U.S. application Ser. No. 11/222,283 is a continuation-in-part of U.S. patent application Ser. No. 10/463,774, filed on Jun. 16, 2003, and entitled "Helmet Chinstrap", presently pending.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to chin guards for use with helmets. More particularly, the present invention relates to chin guards that have protective cups associated therewith for protection of the chin of the wearer. More particularly, the present invention relates to chin guards apparatus that have a single resilient layer extending across an interior surface of the protective cup.

2. Description of Related Art Including Information Disclosed Under 37 CFR 1.97 and 37 CFR 1.98.

The invention relates to improvements in protective headgear such as football helmets, motorcycle and bicycle helmets, and helmets for other activities where protection from head impact and injury is desirable. The invention also relates to protective pads, particularly chin pads.

Protective helmets to minimize head injuries have been known and used for many years. For example, football helmet shells have been produced from injection molded ABS, or polycarbonate plastic. Helmets intended for youth usage have usually been produced from ABS plastic, and helmets for adult usage have usually been produced from polycarbonate plastic. ABS plastic is significantly less expensive than polycarbonate, but ABS plastic is not as structurally rigid as polycarbonate. As the level of intensity of contact in youth football is significantly lower than that at the adult level, ABS has been accepted as a satisfactory material for use at the youth level. For adult helmets, however, the structural rigidity of the polycarbonate material is essential to minimize the flex and deformation of the shell under extreme impact conditions.

The National Operating Committee on Standards for Athletic Equipment (NOCSAE) has been responsible for setting minimal performance criteria for football helmets. The minimum standard acceptance level measured by the Severity Index (IS) is set at 1200. Through the continuous testing of NOCSAE, it has been established that the rigidity of polycarbonate shells, in comparison to ABS shells, leads to significantly lower IS results. From these tests, it is believed that there is a correlation between the rigidity of the shell material and improved safety performance.

Protection can also be improved by the addition of a face mask attached to the helmet. For example, football helmets are usually equipped over the exposed face area with a vinyl coated wire or other metal structure, or an injection molded plastic face mask. The obvious purpose of the face mask is to protect the face of the player from injury, while not obstructing the player's vision unnecessarily. The addition of a face mask can also increase the rigidity of the shell which improves the IS performance. Helmets are usually tested without face masks so that the IS performance of a helmet with the mask will somewhat exceed the test standard.

Face masks have been mounted to the exterior surface of the helmet shell behind the front edge of the helmet face opening. This design can, under certain conditions, contribute to serious injury. Helmet shells are specifically designed with smooth spherical surfaces to allow the shells to glance and slide on impact.

Protective helmets usually include a chin strap to retain the helmet, particularly during impact. In the past, chin straps were frequently constructed using a molded plastic cup made of compression or injection-molded plastic material. A pad, usually of a felt or foam material, was bonded or otherwise attached to the plastic cup. This cup construction is preferable to non-padded chin straps which have been standard equipment on football helmets. Non-padded chin straps do not offer any impact protection to the chin area, and only serve to secure the helmet to the player's head. Padded chin cups provide an added measure of protection to the chin from impacts, in addition to securing the helmet to the player's head.

Improvement in the impact absorption performance of padded chin straps is desirable. Most molded plastic chin cups currently used are molded in a manner which allows the formed cup to flex upon impact. An improved construction is a rigid material which does not flex on impact to an undesirable degree, thus distributing the impact force over a larger area of the chin.

Another shortcoming of existing chin guards is that the padding material is permanently bonded to the plastic chin cup. As football is often times played in muddy conditions, the pads tend to become dirty. Sweat and body oil accumulate and compound the problem of how to keep the product clean and sanitary over extended use.

The present inventor is the owner of U.S. Pat. No. 6,298,493, issued on Oct. 1, 2001 to Schiebl et al. U.S. Pat. No. 6,298,493 describes a protective headgear that comprises a rigid shell with face pads that can be released and removed while the headgear is still on a person's head. A protective chin guard is attached to the headgear by way of the face pads. The chin guard includes a substantially rigid shell with a removable insert made of a flexible bladder filled with a shock-absorbing fluid. The headgear includes a shell made of an inner and outer material layered over an internal foam core to effect both strength and light weight construction.

The cup associated with the protective shell of the chin strap often has had an imperfect fit with the wearer's chin. In certain circumstances, the user may desire to have enhanced protection against impacts. The wearer may also desire a more comfortable fit with the cup of the shell of the protective chin strap and more comfortable contact between the chin and an interior surface of the chin guard. Often, the cup of the chin strap has a peripheral edge which bears against the skin of the user. In the event of an impact, this edge can bruise the chin of the user. In the event of a severe impact, the peripheral edge of the protective shell of the chin strap can cause adverse impacts to the face of the user. As such, a need has developed whereby the edge of the shell of the cup of the chin strap be fully cushioned and protected from the skin of the wearer.

It is an object of the present invention to provide a chin guard apparatus which maximizes the protection and comfort of the user.

It is another object of the present invention to provide a chin strap apparatus which enhances the degree of protection against the peripheral edge of the rigid shell of the cup of the chin guard apparatus.

It is a further object of the present invention to provide a chin guard apparatus whereby the cushion of the cup can be adapted to properly fit the facial configuration and desires of the user.

It is another object of the present invention to provide a chin guard apparatus that enhances shock absorption on the exterior surface of the protective shell of the chin guard.

It is still a further object of the present invention to provide a chin guard apparatus to provide air circulation and comfortable contact with the skin of the user.

It is another object of the present invention to provide a chin guard apparatus that is relatively inexpensive, easy to manufacture and easy to assemble.

These and other objects and advantages of the present invention will become apparent from a reading of the attached specification and appended claims.

BRIEF SUMMARY OF THE INVENTION

The present invention is a chin guard apparatus for use with a helmet. This chin guard has a shell with a cup suitable for fitting upon a human chin. The shell has an outer peripheral edge. A resilient layer is received within in the cup of the shell. This resilient layer has a periphery overlying the outer peripheral edge of the shell.

In the present invention, the resilient layer has a support layer in surface-to-surface contact with a surface of the shell and a plurality of padded sections integrally formed with the support layer. This plurality of padded sections includes a rectangular portion extending centrally across the support layer on a side opposite the cup and a plurality of fingers extending outwardly of the rectangular portion. Each of the plurality of fingers extends in generally parallel spaced relationship to the rectangular portion. Each of the plurality of fingers has an end adjoining the rectangular portion of the central area of the rectangular portion.

The shell has a plurality of through holes formed in the cup. Additionally, the resilient layer has a plurality of through holes formed therein so as to align with the through holes of the shell. These through holes open at a space between the plurality of fingers and the rectangular portion. Each of the plurality of through holes of the resilient layer and of the shell open at a space between each of the plurality of fingers and the rectangular portion of the resilient layer. The cup also has at least one opening formed generally centrally of the cup. The resilient layer has an insert member extending into the opening so as to generally retain the resilient layer within the shell. In the preferred embodiment, the cup has a pair of generally semicircular openings formed generally centrally of the cup. Each of the plurality of semi-circular openings receives a semi-circular-shaped insert member of the resilient layer.

The outer peripheral edge of the shell is flanged outwardly of the cup. The periphery of the resilient layer extends over and beyond the outer periphery of the shell. The resilient layer is formed of a foamed polymeric material. The shell is formed of a rigid polymeric material. The shell has a first slot formed on one side thereof and a second slot formed on an opposite side thereof. The resilient layer has a channel formed on opposite sides thereof so as to overlie the first and second slots.

DETAILED DESCRIPTION OF THE INVENTION

Figure 1:
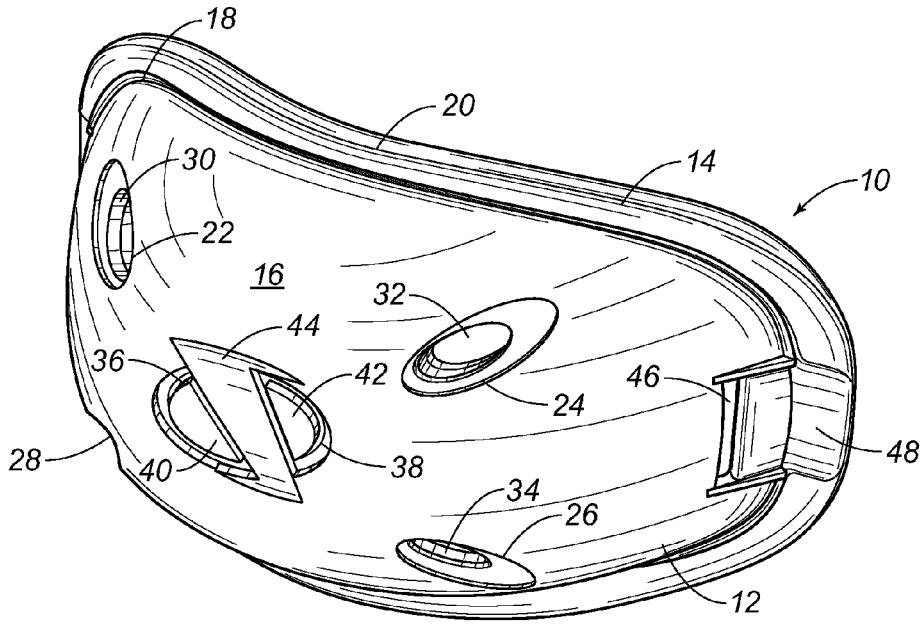
FIG. 1 is a perspective view of the chin guard in accordance with the preferred embodiment of the present invention.

Referring to FIG. 1, there is shown the chin guard 10 in accordance with the preferred embodiment of the present invention. The chin guard 10 includes a shell 12 and a resilient layer 14. The shell 12 has a cup 16 suitable for fitting upon a human chin. The shell has an outer peripheral edge 18 that extends therearound and extends outwardly of the outer periphery of the cup 16. The resilient layer 14 is received within the cup 16 of shell 12. The resilient layer 14 has a periphery 20 which overlies the outer peripheral edge 18 of the shell 12.

As can be seen in FIG. 1, the shell 12 is formed of a rigid polymeric material. Holes 22, 24, 26 and 28 are formed through the shell 12 so as to allow air circulation to contact the chin of the user. Similarly, as will be described hereinafter, the resilient layer 14 also includes holes 30, 32 and 34 which are aligned with the through holes 22, 24 and 26, respectively, of the shell 12. This arrangement of aligned holes ensures proper air circulation to the chin of the wearer.

The shell 12 also includes a first generally semi-circular opening 36 and a second semi-circular opening 38 formed centrally of the cup 16. The semi-circular openings 36 and 38 will receive semi-circular shaped insert members 40 and 42, respectively, of the resilient layer 14. A bumper member 44 is received between the semi-circular openings 36 and 38 so as to extend thereacross. Bumper member 44 can provide shock absorbency at the very center of the shell 12. The bumper member 44 can be formed of a rubber material.

The shell 12 includes a slot 46 formed on one side and another slot formed on the opposite side. The slot 46 is suitable for receiving the strap which serves to connect the chin guard 10 to a helmet. A suitable channel 48 can be formed on the resilient member 14 generally adjacent to the slot 46 so as to provide a suitable guide for the chin strap extending thereacross.

The shell 12 is formed of a rigid polymeric material while the resilient layer 14 is formed of a foamed polymeric layer. Since there are only two main components of the chin guard 10 of the present invention, the chin guard 10 can be assembled in an easy manner. Additionally, the manufacturing costs associated with forming the chin guard 10 of the present invention are minimal. These goals can be accomplished while, at the same time, providing maximum protection to the wearer of the chin guard. Since the resilient layer 14 overlies the outer peripheral edge 18 of the shell 12, sharp contacts between the outer peripheral edge 18 of the shell 12 and the face of the wearer are effectively cushioned.

Figure 2:
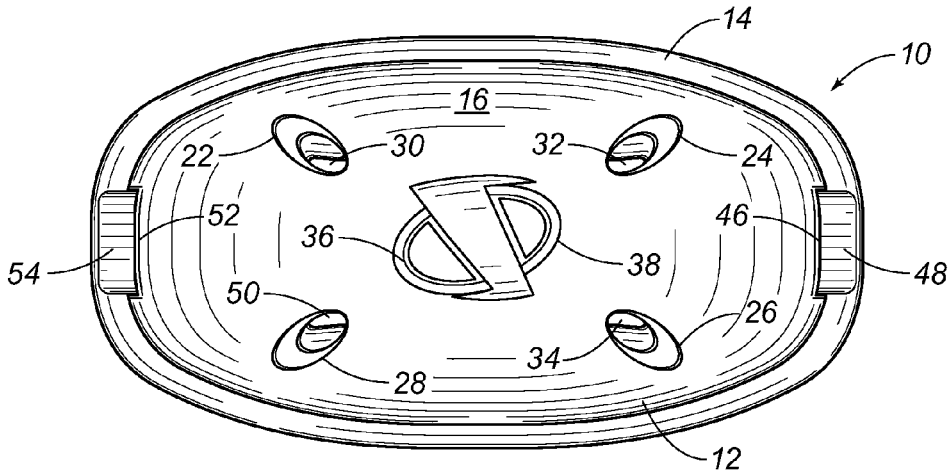
FIG. 2 is a frontal view of the chin guard of the present invention.

FIG. 2 shows a front view of the chin guard 10 of the present invention. In FIG. 2, the holes 22, 24, 26 and 28 are fully illustrated. Each of these holes 22, 24, 26 and 28 has a generally oval or oblong configuration. The respective holes 30, 32, 34 and 50 of the resilient layer 14 are illustrated as aligned with the respective holes 22, 24, 26 and 28. The oval nature of the holes 22, 24, 26 and 28 assures full air circulation to the wearer even in the event that the resilient layer 14 has shifted slightly out of position. The semi-circular openings 36 and 38 are illustrated as located within the center of the cup 16 of shell 12. The bumper member 44 has a generally reverse Z-shaped configuration. The slot 46 is formed on side of the shell 12 while the slot 52 is formed on the opposite side of the shell. Channel 48 is aligned with the slot 46 on one side of the shell 12. A channel 54 is aligned with the slot 52 on the opposite side of the shell 12. Channels 48 and 54 are formed in the edge surface of the resilient layer 14 which overlies the outer peripheral edge 18 of the shell 12.

Figure 3:
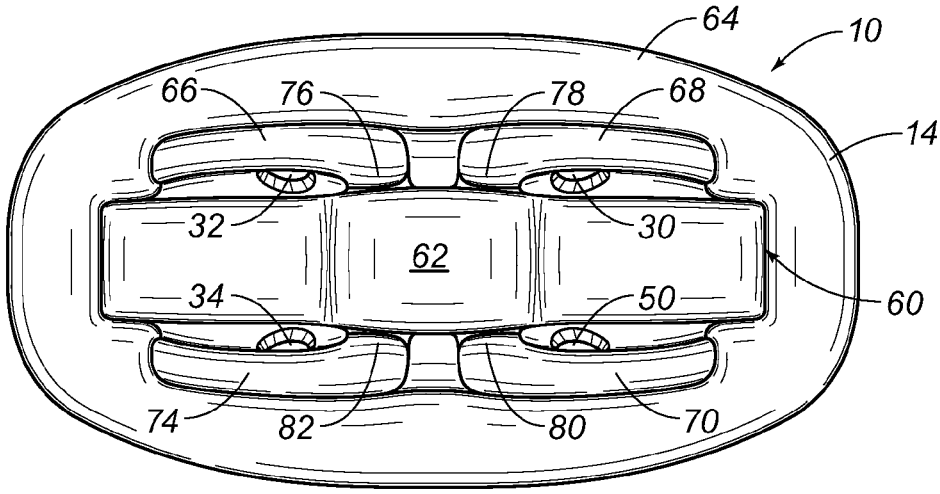
FIG. 3 is a back view of the chin guard of the present invention.

FIG. 3 illustrates the interior of the chin guard 10 of the present invention. In FIG. 3, the resilient layer 14 is particularly illustrated. The resilient layer 14 has padded surfaces 60 formed therein. The padded surfaces 60 include a rectangular portion 62 extending centrally across a support layer 64 of the resilient layer 14. The support layer 64 is positioned so as to be in surface-to-surface contact with the interior surface of the shell 12. The padded surfaces 60 are integrally formed with the support layer 64. Finger members 66, 68, 70 and 74 are also integrally formed with the support layer 64 and extend in generally spaced relationship to the edges of the rectangular portion 62. The finger 66 has an adjoining portion 76 connected to the rectangular portion 62. The finger 68 has an adjoining portion 78 connected to the rectangular portion 62. The finger 70 has an adjoining portion 80 connected to the rectangular portion 62. The finger 74 has an adjoining portion 82 connected to the rectangular portion 62. The adjoining portions 76, 78, 80 and 82 are located in a central area of the rectangular portion 62. The spacing between the fingers 66, 68, 70 and 74 and the rectangular section 62 is intended to accommodate the through holes 30, 32, 34 and 50 which are formed through the support layer 64 are aligned with the respective through holes formed in the shell 12. As such, the arrangement of the various padded surfaces 60 in the resilient layer 14 assures a proper air flow through the through holes to the chin of the wearer.

Figure 4:
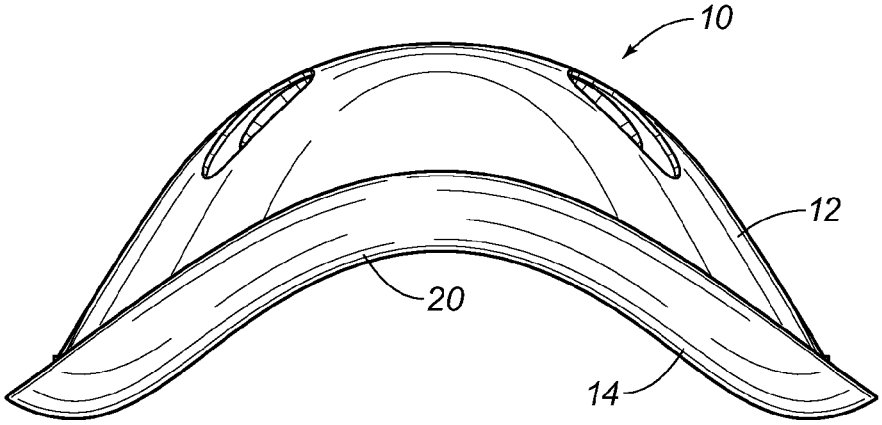
FIG. 4 is a side elevational view of the chin guard of the present invention.

FIG. 4 illustrates a plan view of the chin guard 10 of the present invention. In FIG. 4, it can be seen that the resilient layer 14 has a peripheral surface 20 which overlies and extends rearwardly over the outer peripheral edge 18 of the shell 12. This lengthy overlying relationship assures a protective cushioning effect against any sharp edges of the rigid shell 12.

Figure 5:
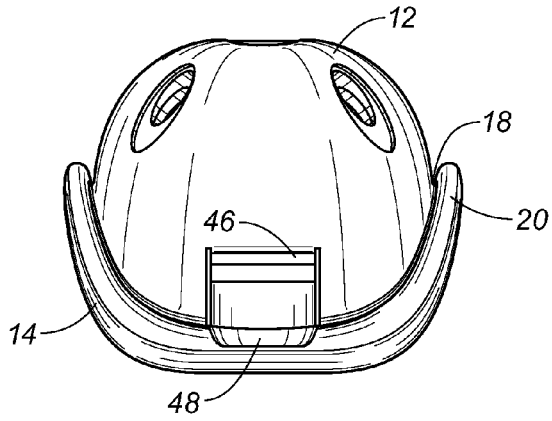
FIG. 5 is an end view of the chin guard of the present invention.

In FIG. 5, the resilient layer 14 is further illustrated as having its outer periphery 20 extending over and beyond the outer peripheral edge 18 of the shell 12 on opposite sides of the shell 12. The channel 48 is illustrated as formed in surface of the outer periphery 20 of the resilient layer 14 so as to generally align with the slot 46 formed in the shell 12.

Figure 6:
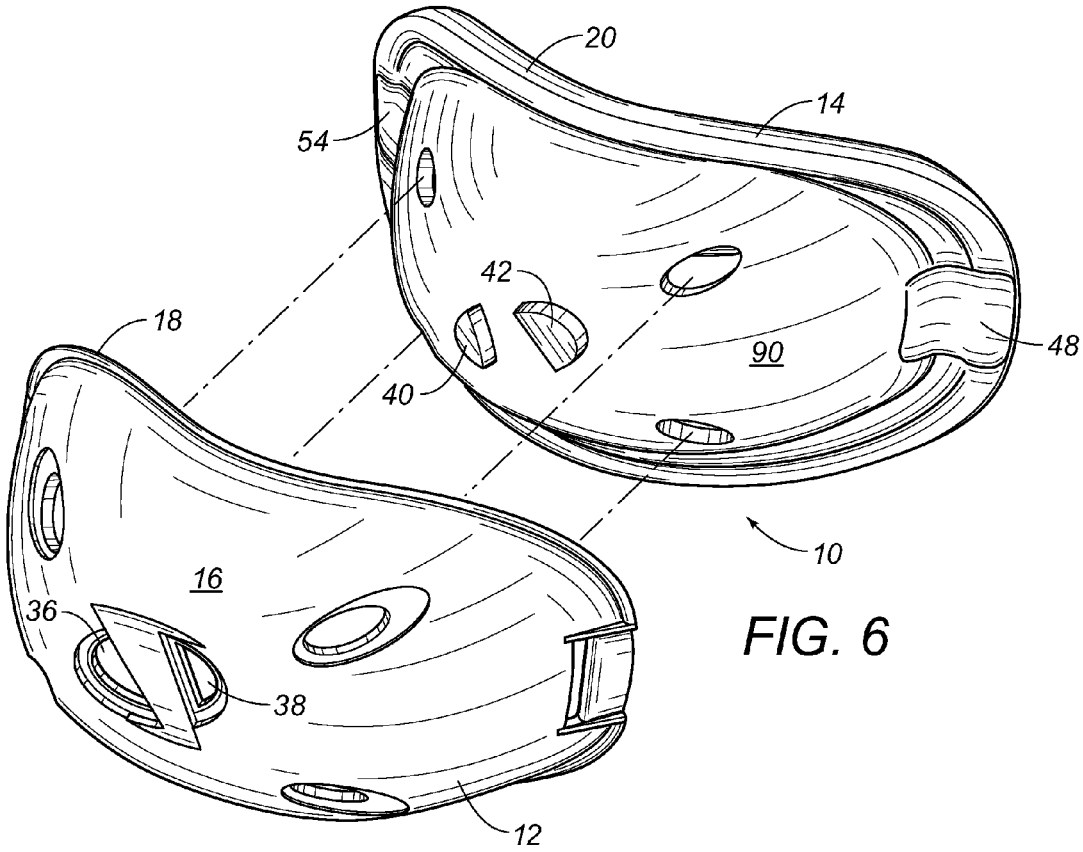
FIG. 6 is an upper perspective exploded view of the chin guard of the present invention.

FIG. 6 illustrates the manner in which the resilient layer 14 is received within the shell 12 of the chin guard 10 of the present invention. In FIG. 6, the shell 12 has cup 16 which serves to receive the cup area 90 of the resilient layer 14. The semi-circular insert members 40 and 42 are positioned so as to be received by the semi-circular indentations 36 and 38 located centrally on the shell 12. This arrangement serves to retain to the resilient layer 14 removably within the interior of the cup 16 of the shell 12. FIG. 6 shows that the through holes of the resilient layer 14 are aligned with the through holes of the shell 12 when the insert members 40 and 42 are received within the semi-circular openings 36 and 38 of the shell 12. The shell 12 is illustrated as having its outer peripheral edge 18 slighted flanged outwardly of the shell 12. The outer peripheral edge 20 has a suitable size so as to completely cover this outer peripheral edge 18 and to provide effective protection against sharp impacts caused by the outer peripheral edge 18 against the face of the wearer. The resilient layer 14 is illustrated as having a channels 48 and 54 formed on opposite sides thereof so as to align with the strap-receiving slots formed on the shell 12. These surfaces provide a guide for the strap which emanates through the slots on the shell 12.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A chin guard comprising:

a shell having a cup suitable for fitting upon a human chin, said shell having an outer peripheral edge; and a resilient layer received within said cup of said shell, said resilient layer having a periphery overlying said outer peripheral edge of said shell, said resilient layer having a support layer in surface-to-surface contact with a surface of said shell and a padded section affixed with said support layer, the padded section comprising:

a portion extending centrally across said support layer on a side opposite said cup; and a plurality of fingers extending from said portion.

2. The chin guard of claim 1, each of said plurality of fingers extending in generally parallel spaced relationship to said portion.

3. The chin guard of claim 1, each of said plurality of fingers having an end adjoining said portion at the central area of said portion, said portion being of a generally rectangular shape.

4. The chin guard of claim 1, said shell having a plurality of through holes formed in said cup, each of said plurality of through holes opening at a space between said plurality of fingers and said portion.

5. A chin guard comprising:

a shell suitable for fitting upon a human chin, said shell having an outer peripheral edge; and a resilient layer received within said cup of said shell, said resilient layer having a support layer in surface-to-surface contact with a surface of said shell and a padded section integrally formed with said support layer, said padded section comprising:

a portion extending centrally across said support layer on a side opposite said cup; and a plurality of fingers extending outwardly of said portion.

6. The chin guard of claim 5, each of said plurality of fingers extending in generally parallel spaced relationship to said portion, each of said plurality of fingers having an end adjoining said portion at a central area of said portion, said portion having a rectangular shape.

7. The chin guard of claim 5, said resilient layer having a periphery overlying said outer peripheral edge of said shell.

8. The chin guard of claim 5, said shell having a plurality of through holes formed in said cup, said resilient layer having through holes formed therein so as to align with said through holes of said shell, each of said plurality of through holes opening at a space between said plurality of fingers and said portion.

9. The chin guard of claim 5, said cup having at least one opening formed centrally of said cup, said resilient layer having an insert member extending into the opening so as to generally retain said resilient layer in said shell.

10. The chin guard of claim 5, said outer peripheral edge of said shell being flanged outwardly from said cup, said periphery of said resilient layer extending over and beyond said outer peripheral edge of said shell.

11. The chin guard of claim 5, said resilient layer being of a foamed polymeric material, said shell being of rigid polymeric material.

* * * * *